US012742590B2

(12) United States Patent
Muraoka et al.

(10) Patent No.: US 12,742,590 B2
(45) Date of Patent: Sep. 22, 2026

(54) LIQUEFIED HYDROGEN PRODUCTION DEVICE

(71) Applicant: JGC CORPORATION, Kanagawa (JP)

(72) Inventors: Tomohide Muraoka, Kanagawa (JP); Masataka Nakane, Kanagawa (JP); Tomoharu Inoue, Kanagawa (JP); Takatoshi Nagai, Kanagawa (JP)

(73) Assignee: JGC CORPORATION, Kanagawa (JP)

( * ) Notice: Subject to any disclaimer, the term of this patent is extended or adjusted under 35 U.S.C. 154(b) by 511 days.

(21) Appl. No.: 18/270,201

(22) PCT Filed: Feb. 12, 2021

(86) PCT No.: PCT/JP2021/005352

§ 371 (c)(1),
(2) Date: Jun. 28, 2023

(87) PCT Pub. No.: WO2022/172415

PCT Pub. Date: Aug. 18, 2022

(65) Prior Publication Data

US 2024/0093937 A1 Mar. 21, 2024

(51) Int. Cl.

| | |
|---|---|
| ***F25J 1/02*** | (2006.01) |
| ***F25J 1/00*** | (2006.01) |
| ***F25J 3/04*** | (2006.01) |

(52) U.S. Cl.

CPC ..... *F25J 1/0283* (2013.01); *F25J 1/001* (2013.01); *F25J 1/005* (2013.01); *F25J 1/0067* (2013.01);

(Continued)

(58) Field of Classification Search

CPC .. F25J 1/0283; F25J 1/001; F25J 1/005; F25J 1/0067; F25J 1/0072; F25J 3/04533;

(Continued)

(56) References Cited

U.S. PATENT DOCUMENTS 2,621,475 A * 12/1952 Loy ..... F02C 3/34 60/774
4,434,613 A * 3/1984 Stahl ..... F25J 3/04127 60/39.182

(Continued)

FOREIGN PATENT DOCUMENTS

CN 115451647 B * 8/2023 ..... F25J 1/001
JP S63169468 7/1988

(Continued)

OTHER PUBLICATIONS

"International Search Report (Form PCT/ISA/210) of PCT/JP2021/005352", mailed on Apr. 20, 2021, with English translation thereof, pp. 1-4.

(Continued)

*Primary Examiner* — Joel M Attey
*Assistant Examiner* — Ibrahim A. Michael Adeniji
(74) *Attorney, Agent, or Firm* — JCIPRNET

(57) ABSTRACT

Liquid hydrogen is produced while reducing emission of carbon dioxide to the atmosphere. Provided is a liquid hydrogen production device including: a carbon dioxide cycle plant (2), which includes a turbine (23) using a carbon dioxide fluid as a driving fluid, and is configured to drive the turbine (23) to generate motive power with use of a carbon dioxide cycle in which the carbon dioxide fluid discharged from the turbine (23) is increased in pressure and heated and is then re-supplied to the turbine (23); and a liquefaction plant (4) configured to cool gaseous hydrogen by heat exchange with a refrigerant, to obtain liquid hydrogen. The motive power generated by driving of the turbine (23) is used as motive power to be consumed in the liquefaction plant (4).

7 Claims, 5 Drawing Sheets

(52) U.S. Cl.
CPC ..... *F25J 1/0072* (2013.01); *F25J 3/04533* (2013.01); *F25J 2205/70* (2013.01); *F25J 2230/30* (2013.01); *F25J 2260/80* (2013.01)

(58) Field of Classification Search
CPC .. F25J 2205/70; F25J 2230/30; F25J 2260/80; F25J 1/0242; F25J 1/0281; F25J 1/0284; F25J 1/0288; F25J 1/0289
See application file for complete search history.

(56) References Cited

U.S. PATENT DOCUMENTS

| | | | | |
|---|---|---|---|---|
| 4,498,289 | A * | 2/1985 | Osgerby | F02C 6/003 60/647 |
| 2005/0210881 | A1* | 9/2005 | Balan | C01B 3/34 60/39.12 |
| 2007/0130957 | A1* | 6/2007 | Hoffmann | F02C 6/18 60/39.15 |
| 2018/0128172 | A1* | 5/2018 | Allam | C01B 3/36 |

FOREIGN PATENT DOCUMENTS

| | | | | |
|---|---|---|---|---|
| JP | 2004210597 | | 7/2004 | |
| JP | 2004210597 | A * | 7/2004 | F25J 1/0228 |
| JP | 2009114042 | | 5/2009 | |
| JP | 2016183827 | | 10/2016 | |
| JP | WO2017154044 | | 1/2019 | |
| JP | 2021012013 | | 2/2021 | |

OTHER PUBLICATIONS

"Office Action of Saudi Arabia Counterpart Application", issued on Apr. 22, 2025, with English translation thereof, p. 1-p. 10.

N.T. Weiland et al., "12—Fossil energy", Fundamentals and Applications of Supercritical Carbon Dioxide ($sCO_2$) Based Power Cycles, Jan. 2017, pp. 293-338.

Bahram Ghorbani et al., "Integrated Fischer-Tropsch synthesis process with hydrogen liquefaction cycle", Journal of Cleaner Production, vol. 283, Oct. 2020, pp. 1-19.

* cited by examiner

LIQUEFIED HYDROGEN PRODUCTION DEVICE

CROSS-REFERENCE TO RELATED APPLICATION

This application is a 371 application of International PCT application serial no. PCT/JP2021/005352, filed on Feb. 12, 2021. The entirety of the above-mentioned patent application is hereby incorporated by reference herein and made a part of this specification.

TECHNICAL FIELD

The present invention relates to a technology for producing liquid hydrogen through liquefaction of gaseous hydrogen.

BACKGROUND ART

In recent years, there is a demand for reduction of an amount of greenhouse gas emission, and attention is being attracted to a fuel cell and a zero-emission fuel that is a carbon-neutral fuel represented by hydrogen and a biofuel that serve as an energy source of thermal power generation in the future.

Hydrogen is purified by steam reforming of hydrocarbon as described in, for example, Patent Literature 1 and Patent Literature 2. Hydrogen produced in the described manner is liquefied in order to facilitate transportation and storage thereof. However, due to an extremely low liquefaction temperature of hydrogen, much energy is required during a process of producing liquid hydrogen. Obtaining such energy for liquefaction of hydrogen may consequently cause emission of a large amount of carbon dioxide. Thus, also in a process of producing liquid hydrogen, a technology for reducing emission of carbon dioxide to the atmosphere is required.

CITATION LIST

Patent Literature

[Patent Literature 1] JP 2009-114042 A
[Patent Literature 2] JP WO2017/154044 A1

SUMMARY OF INVENTION

Technical Problem

The present technology provides a technology for producing liquid hydrogen while reducing emission of carbon dioxide to the atmosphere.

Solution to Problem

According to the present invention, there is provided a liquid hydrogen production device including:

a carbon dioxide cycle plant, which includes a turbine using a carbon dioxide fluid as a driving fluid, and is configured to drive the turbine to generate motive power with use of a carbon dioxide cycle in which the carbon dioxide fluid discharged from the turbine is increased in pressure and heated and is then re-supplied to the turbine; and a liquefaction plant configured to cool gaseous hydrogen by heat exchange with a refrigerant, to obtain liquid hydrogen, wherein the motive power generated by driving of the turbine is used as motive power to be consumed in the liquefaction plant.

The liquid hydrogen production device may have the following features.

(a) The liquefaction plant includes:

a hydrogen compressor configured to compress gaseous hydrogen;

a refrigeration cycle including:

a refrigerant compressor configured to compress the refrigerant for cooling and liquefying the hydrogen; and an expansion turbine or a pressure reducing value configured to cool the refrigerant compressed by the refrigerant compressor and adiabatically expand the refrigerant, to reduce a temperature of the refrigerant; and a heat exchanger configured to perform heat exchange between the compressed hydrogen and the refrigerant that is adiabatically expanded to have a reduced temperature, to cool the compressed hydrogen and obtain the liquid hydrogen, and the refrigerant compressor is configured to be driven with use of the motive power generated in the carbon dioxide cycle plant.

(b) The refrigerant compressor is connected to the turbine of the carbon dioxide cycle plant and is configured to be driven through mechanical transmission of the motive power generated in the turbine.

(c) A power generator is connected to the turbine of the carbon dioxide cycle plant, and the refrigerant compressor is driven by power obtained by driving of the power generator with use of the motive power generated in the turbine.

(d) A hydrogen production plant configured to produce the gaseous hydrogen is provided.

(e) A power generator is connected to the turbine of the carbon dioxide cycle plant, and the hydrogen production plant is configured to be driven by power obtained by driving of the power generator with use of the motive power generated in the turbine.

(f) The hydrogen production plant is configured to produce gaseous hydrogen by reforming hydrocarbon with steam.

(g) The hydrogen production plant is configured to produce gaseous hydrogen by water electrolysis.

(h) A power generator is connected to the turbine of the carbon dioxide cycle plant, and the water electrolysis in the hydrogen production plant is performed by power obtained by driving of the power generator with use of the motive power generated in the turbine.

(i) A pretreatment unit configured to perform at least one of dehydration of gaseous hydrogen before liquefaction in the liquefaction plant, or removal of carbon dioxide mixed into gaseous hydrogen is provided.

(j) In a case in which the pretreatment unit performs at least one of dehydration with use of an adsorbent or removal of the carbon dioxide with use of an absorption liquid, the liquid hydrogen production device further includes a first exhaust-heat recovery unit configured to recover heat from the carbon dioxide fluid provided after the turbine of the carbon dioxide cycle plant is driven, and the heat recovered by the first exhaust-heat recovery unit is used for a regeneration process performed by heating the adsorbent or the absorption liquid is heated.

(k) In a case in which the pretreatment unit performs at least one of dehydration with use of an adsorbent or removal of the carbon dioxide with use of an absorption liquid, the liquid hydrogen production device further includes a hydrogen production plant that is configured to produce the gaseous hydrogen, and includes:

a reforming unit configured to reform hydrocarbon by causing a reaction with steam to produce gaseous hydrogen; and a second exhaust-heat recovery unit configured to recover heat generated by the reaction between steam and hydrocarbon in the reforming unit, and the heat recovered by the second exhaust-heat recovery unit is used for a regeneration process performed by heating the adsorbent or the absorption liquid.

Advantageous Effects of Invention

According to the liquid hydrogen production device, the liquefaction plant configured to liquefy gaseous hydrogen is attached with the carbon dioxide cycle plant that obtains motive power with use of a carbon dioxide cycle, and hydrogen is liquefied by the motive power.

With this configuration, motive power for liquefaction of hydrogen that requires much energy can be obtained with use of a carbon dioxide cycle that can recover carbon dioxide at a high concentration, which enables reduction of emission of carbon dioxide to the atmosphere.

DESCRIPTION OF EMBODIMENTS

Figure 1:
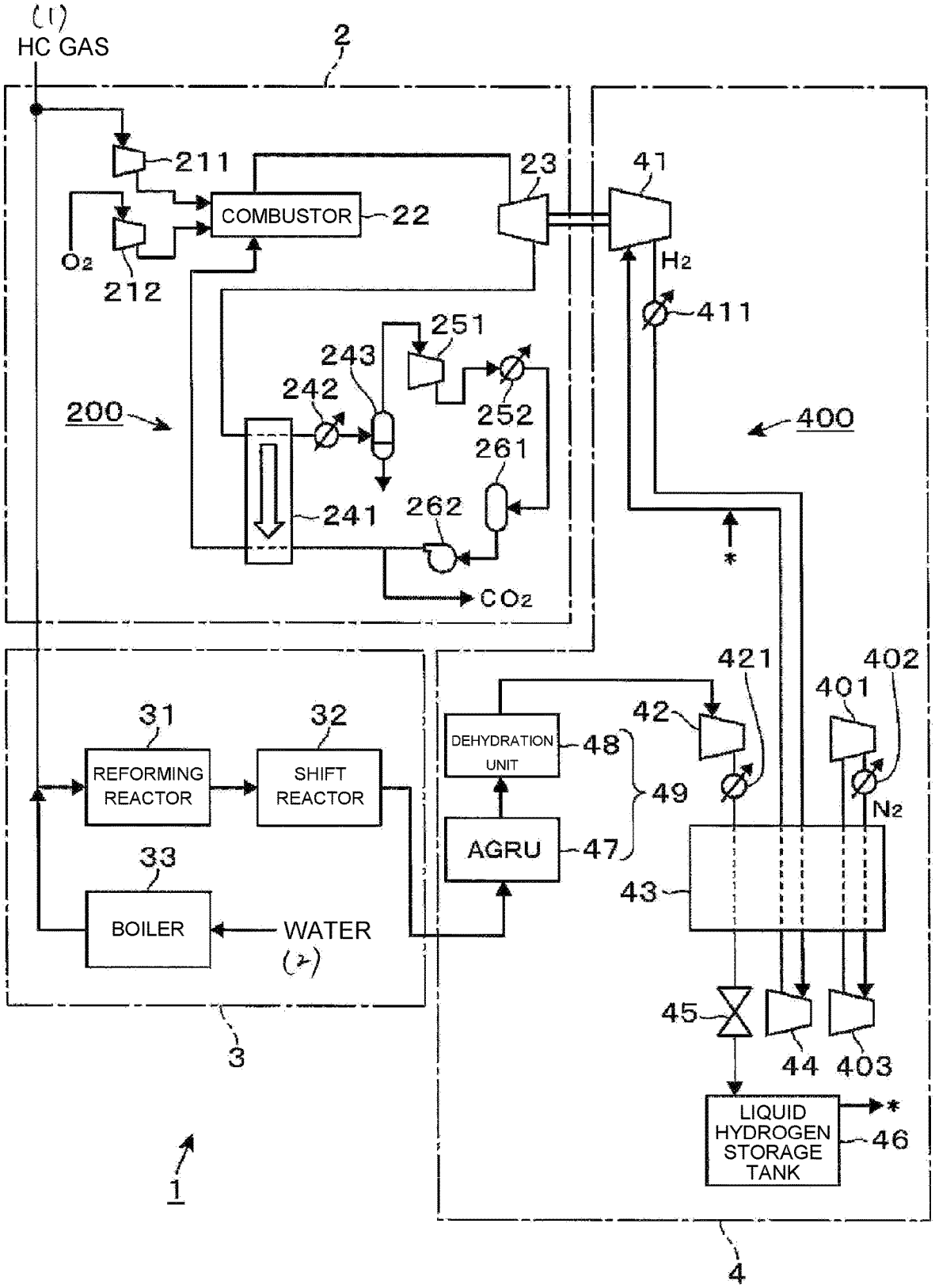
FIG. 1 is a configuration diagram for illustrating an example of a liquid hydrogen production system according to an embodiment.

FIG. 1 is a configuration diagram of a liquid hydrogen production system 1 corresponding to a liquid hydrogen production device according to a first embodiment. The liquid hydrogen production system 1 of this embodiment includes a hydrogen production plant 3 and a liquefaction plant 4. The hydrogen production plant 3 is configured to produce gaseous hydrogen ($H_2$) from hydrocarbon. The liquefaction plant 4 is configured to liquefy gaseous $H_2$. Further, the liquefaction plant 4 is attached with a supercritical (SC)-$CO_2$ cycle plant (carbon dioxide cycle plant) 2 that has a $CO_2$ cycle for generation of motive power in which a carbon dioxide ($CO_2$) fluid in a supercritical state is used as a driving fluid. The liquid hydrogen production system 1 of this embodiment has a configuration in which the SC-$CO_2$ cycle plant generates motive power to be consumed in the liquefaction plant 4.

The hydrogen production plant 3 generates synthesis gas composed mainly of $H_2$ gas from hydrocarbon (HC) gas (HC gas). The hydrogen production plant 3 uses natural gas (NG) composed mainly of methane as, for example, HC gas, and includes a reforming reactor 31 that is a reforming unit configured to reform HC gas. Alternatively, the hydrogen production plant 3 may produce $H_2$ with use of HC gas obtained by, for example, gasification of coal.

For example, in the hydrogen production plant 3, steam supplied from a boiler 33 and HC gas that are mixed with each other (mixed gas) are supplied to the reforming reactor 31. Then, the hydrogen production plant 3 heats the mixed gas to a temperature of, for example, from 300° C. to 450° C., in the presence of a catalyst, to cause a steam reforming reaction to proceed, thereby generating reformed gas including $H_2$ and CO. The reformed gas is gas in which $H_2$, $CO_2$, CO, and $H_2O$ are mixed with each other. Note that the reformed gas additionally includes a small amount of hydrogen sulfide ($H_2S$) gas and the like.

The reformed gas generated in the reforming reactor 31 is supplied to a shift reactor 32 that is a shift reaction unit filled with a catalyst. In the shift reactor 32, when the reformed gas is supplied, a shift reaction in which $H_2$ and $CO_2$ are generated from CO and $H_2O$ proceeds. As a result, reformed gas with reduced CO (hereinafter referred to as "synthesis gas") is generated.

The synthesis gas obtained in the hydrogen production plant 3 is supplied to the liquefaction plant 4. The liquefaction plant 4 is a plant configured to cool $H_2$ gas included in the synthesis gas to produce liquid hydrogen. The liquefaction plant 4 includes a pretreatment unit 49 configured to remove acid gas and moisture mixed into the synthesis gas, and cools the synthesis gas having been subjected to pretreatment to produce liquid hydrogen.

The pretreatment unit 49 includes an acid gas removal unit (AGRU) 47 and a dehydration unit 48. The acid gas removal unit (AGRU) 47 is configured to separate acid gas included in the synthesis gas, such as $CO_2$ and $H_2S$. The dehydration unit 48 is configured to remove moisture included in the synthesis gas.

The AGRU 47 removes acid gas that may possibly be solidified during cooling of the synthesis gas, such as $CO_2$ and $H_2S$. Examples of a method of removing acid gas include a method that uses a gas absorption liquid including an amine compound in an absorption column and a method that uses a gas separation membrane which allows acid gas in the synthesis gas to permeate.

The dehydration unit 48 removes a small amount of moisture included in the synthesis gas. For example, the dehydration unit 48 includes an adsorption column filled with an adsorbent such as a molecular sieve and silica gel for removing moisture. There are provided a plurality of adsorption columns, and a process of removing moisture in the synthesis gas and a process of regenerating an adsorbent having adsorbed moisture are performed alternately. Further, the dehydration unit 48 includes a device that heats regeneration gas for an adsorbent (for example, synthesis gas provided after removal of moisture), such as a heater.

The liquefaction plant 4 cools $H_2$ gas by heat exchange between $H_2$ gas provided after removal of acid gas and moisture from the synthesis gas, and a refrigerant, to obtain liquid hydrogen. In the liquefaction plant 4 of this embodiment, $H_2$ is used as a refrigerant that cools $H_2$ gas. More specifically, a case in which boil-off gas generated by vaporization of a part of liquid hydrogen in a liquid hydrogen storage tank 46 is used can be exemplified.

The liquefaction plant 4 includes a heat exchanger 43 that performs heat exchange between $H_2$ gas and a refrigerant. FIG. 1 shows collectively the heat exchanger for convenience of illustration, but the liquefaction plant 4 is provided with a plurality of heat exchangers 43, and $H_2$ gas and a refrigerant are cooled with use of those heat exchangers 43.

On the inlet side of the heat exchanger 43, a hydrogen compressor 42 that is a compressor configured to increase the pressure of $H_2$ gas is provided. $H_2$ gas having been subjected to removal of acid gas and dehydration in the pretreatment unit 49 is supplied to the hydrogen compressor 42. Then, after the pressure of the $H_2$ gas is increased by the hydrogen compressor 42, the $H_2$ gas is cooled in a cooler 421 and supplied to the heat exchanger 43.

Further, the liquefaction plant 4 includes a refrigerant compressor 41 that is a compressor configured to increase the pressure of $H_2$ gas for a refrigerant. After the pressure of the $H_2$ gas for a refrigerant is increased by the refrigerant compressor 41, the $H_2$ gas is cooled in a cooler 411 and is introduced into the heat exchanger 43.

In the heat exchanger 43, the $H_2$ gas for a refrigerant is pre-cooled by a nitrogen refrigerant. Subsequently, the $H_2$ gas for a refrigerant is adiabatically expanded in an expansion turbine 44, and hence the temperature thereof is further reduced. After that, the $H_2$ gas is returned back to the heat exchanger 43. Note that a pressure reducing valve may be used in place of the expansion turbine 44. In this manner, there is formed a refrigeration cycle 400 in which the $H_2$ gas for a refrigerant having a reduced temperature is subjected to heat exchange with $H_2$ gas in the heat exchanger 43, and then is returned back to the refrigerant compressor 41.

Note that the refrigeration cycle 400 of the liquefaction plant 4 is not limited to the refrigeration cycle 400 that uses a dual system of a cooling refrigerant and a pre-cooling refrigerant as described above. For example, a refrigeration cycle in which a single system of only $H_2$ gas for a refrigerant is used without pre-cooling by a nitrogen refrigerant may be formed. Further, the refrigeration cycle may have a plurality of systems of pre-cooling refrigerants. Further, a cooling refrigerant and a pre-cooling refrigerant are not limited to $H_2$ gas and nitrogen. For example, helium and neon may be used for a cooling refrigerant, and light hydrocarbon such as methane, ethane, and propane may be used as a pre-cooling refrigerant.

By the heat exchange between the $H_2$ gas for a refrigerant and the compressed $H_2$ gas as described above, the compressed $H_2$ gas is cooled. The pressure of the further cooled $H_2$ gas is reduced by an expansion valve 45, and the $H_2$ gas is liquefied and stored in the liquid hydrogen storage tank 46.

Note that, the reference symbol 401 of FIG. 1 denotes the nitrogen-refrigerant pressure increasing unit for a nitrogen refrigerant, the reference symbol 402 denotes the cooler that cools a nitrogen refrigerant compressed by the nitrogen-refrigerant pressure increasing unit 401, and the reference symbol 403 denotes the expansion turbine that adiabatically expands a nitrogen refrigerant having been pre-cooled by the heat exchanger 43, reduces the temperature of the nitrogen refrigerant, and then supplies the nitrogen refrigerant to the heat exchanger 43.

In the liquid hydrogen production system 1 of this embodiment, motive power for driving the compressor forming the refrigerant compressor 41 of the liquefaction plant 4 is generated in the SC-$CO_2$ cycle plant 2. The SC-$CO_2$ cycle plant 2 is a plant that drives a turbine 23 to generate motive power with use of $CO_2$ in a supercritical state as a driving fluid. As illustrated in FIG. 1, the SC-$CO_2$ cycle plant 2 includes a $CO_2$ cycle 200 in which $CO_2$ used for driving the turbine 23 is increased in pressure and heated and is then re-supplied to the turbine 23.

In the following, a configuration example of the $CO_2$ cycle 200 is described with reference to FIG. 1.

The $CO_2$ cycle 200 is provided with a combustor 22 configured to combust HC gas and supply $CO_2$. The combustor 22 mixes oxygen ($O_2$) gas and HC gas and combusts the mixed gas in a flow of SC-$CO_2$, to replenish the $CO_2$ cycle 200 with $CO_2$. Further, in the combustor 22, steam is also generated by combustion of HC gas.

In the liquid hydrogen production system 1 of this embodiment, HC gas combusted in the combustor 22 is NG. On the inlet side of the combustor 22, a HC-gas pressure increasing unit 211 configured to increase the pressure of HC gas is provided. HC gas is introduced into the combustor 22 after the pressure thereof is increased to a supply pressure for the $CO_2$ cycle 200.

Further, in the combustor 22, HC gas is combusted with use of high-purity $O_2$ gas having a concentration of, for example, 99.8% or more. The high-purity $O_2$ gas is produced by separation of air into $O_2$ gas and $N_2$ gas by, for example, an air separation unit (ASU) (not shown).

On the inlet side of the combustor 22, an oxygen-gas pressure increasing unit 212 configured to increase the pressure of $O_2$ gas is provided. $O_2$ gas produced in the ASU is introduced into the combustor 22 after the pressure thereof is increased to a supply pressure for the $CO_2$ cycle.

The description refers back to the explanation of the configuration of the $CO_2$ cycle 200. The SC-$CO_2$ replenished with $CO_2$ in the combustor 22 is supplied to the turbine 23, and motive power is obtained when the turbine 23 is driven. The turbine 23 is connected to the compressor forming the refrigerant compressor 41 configured to compress the $H_2$ gas for a refrigerant in the liquefaction plant 4 as described above. Specifically, a rotation shaft of the turbine 23 and a rotation shaft of the refrigerant compressor 41 are mechanically connected, and rotation of the turbine 23 drives the refrigerant compressor 41 to rotate. With this configuration, motive power generated by driving of the turbine 23 is mechanically transmitted, to cause the compressor of the refrigerant compressor 41 to operate, so that the pressure of the refrigerant can be increased.

The $CO_2$ gas discharged from the turbine 23 and reduced in pressure is cooled by heat exchange with $CO_2$ before supply to the combustor 22, in the heat exchanger 241, and then is further cooled in a cooler 242. By those cooling operations, the steam generated by combustion of HC gas condenses, and the resulting moisture is separated by a gas-liquid separator 243.

The $CO_2$ gas from which the moisture has been separated is compressed by a compressor 251 and is further cooled in a cooler 252. Thus, the $CO_2$ gas is converted into liquid $CO_2$ and flows into a drum 261.

The liquid $CO_2$ in the drum 261 is increased in pressure by a pressure increasing pump 262, and is further heated by the heat exchanger 241, to be placed in a SC-$CO_2$ state. The SC-$CO_2$ is supplied to the combustor 22 and is subsequently re-supplied to the turbine 23. In the $CO_2$ cycle 200 of this embodiment, the heat exchanger 241 configured to perform heat exchange with $CO_2$ gas discharged from the turbine 23, and the above-mentioned combustor 22 that uses combustion heat of HC gas, are provided as $CO_2$ heating means.

Further, the SC-$CO_2$ cycle power generation plant 2 of this embodiment has a configuration capable of extracting a part of a $CO_2$ fluid circulating through the $CO_2$ cycle, toward a $CO_2$ receiving facility for, for example, storage, fixation, and use of $CO_2$. In this embodiment, a liquid $CO_2$ extraction line that extracts liquid $CO_2$ before being heated by the heat exchanger 241 from a position on the outlet side of the pressure increasing pump 262 provided in the $CO_2$ cycle, is provided.

For the pressure of the liquid $CO_2$ extracted through the liquid $CO_2$ extraction line, a value in a range of from 8 MPa to 30 MPa can be exemplified. For the flow rate, a value matching the flow rate of $CO_2$ supplied to the $CO_2$ cycle through the combustor 22 can be exemplified.

The liquid $CO_2$ extracted through the above-mentioned liquid $CO_2$ extraction line is supplied to at least one carbon dioxide receiving facility ($CO_2$ receiving facility) selected from a facility group consisting of a carbon-dioxide capture and storage (CCS) facility that stores $CO_2$ in an underground aquifer, an enhanced oil recovery (EOR) facility that injects $CO_2$ into an oil field to boost the production of oil, a urea synthesis facility that causes $CO_2$ to react with ammonia ($NH_3$) to synthesize urea, a carbon dioxide mineralization facility that causes $CO_2$ to react with calcium and magnesium to fix the $CO_2$, a methanation facility that produces methane ($CH_4$) with use of $CO_2$ as a raw material, and a photosynthesis-promoting carbon-dioxide supply facility for boosting the production of crops.

Here, the CCS facility may store $CO_2$ in a saline-water aquifer in the sea floor. Further, in a case in which $CO_2$ is supplied to the EOR facility and the CCS facility in parallel, the EOR facility and the CCS facility may share the composing devices thereof.

Note that it is not essentially required that $CO_2$ be extracted in a liquid state. The position where $CO_2$ gas is extracted may be determined depending on the $CO_2$ receiving specification of the $CO_2$ receiving facility. For example, a $CO_2$-gas extraction line serving as an extraction facility may be connected at a position on the outlet side of the gas-liquid separator 243 provided in the $CO_2$ cycle. The pressure of $CO_2$ in the $CO_2$ cycle is higher than the atmospheric pressure, and hence high-purity and high-pressure $CO_2$ can be supplied even in a case in which $CO_2$ gas before being compressed by the compressor 251 is extracted.

As described above, in the SC-$CO_2$ cycle plant 2, a $CO_2$ fluid ($CO_2$ gas, liquid $CO_2$, SC-$CO_2$) is caused to circulate in the $CO_2$ cycle, and thus the turbine 23 is driven, to generate motive power. Further, in the SC-$CO_2$ cycle plant 2, high-purity and high-pressure $CO_2$ can be obtained, and hence $CO_2$ can be captured by $CO_2$ capture means such as the CCS. Thus, an amount of emission of $CO_2$ to the atmosphere can be reduced. Thus, when comparing a plant using a gas turbine that combusts a fuel gas to drive a turbine and a steam turbine that drives a turbine with use of steam generated by combustion of a fuel, no combustion gas including $CO_2$ is emitted to the atmosphere.

The liquid hydrogen production system 1 according to the embodiment described above produces the following effects. $H_2$ gas, which is gaining attention as a zero-emission fuel, requires much energy for production and liquefaction thereof. Especially, much motive power is required in the refrigerant compressor 41 configured to compress a refrigerant used for liquefying $H_2$ gas. As a result, this causes a concern that much $CO_2$ gas may be emitted during a process of producing liquid hydrogen.

In this regard, in the liquid hydrogen production system 1 of the present invention, motive power for the refrigerant compressor 41 is generated in the SC-$CO_2$ cycle plant 2.

The SC-$CO_2$ cycle plant 2 can recover $CO_2$ generated at the time of generation of motive power efficiently and at a high concentration, and thus can significantly reduce emission of $CO_2$ to the atmosphere. As a result, this enables reduction of generation of $CO_2$ in liquefaction of $H_2$ gas that requires much motive power in general. Further, the turbine 23 and the refrigerant compressor 41 are physically connected to drive the refrigerant compressor 41, which eliminates a need for establishment of facilities required for power supply, such as a power generator and a cable, thereby simplifying the configuration of the facility.

In the following, with reference to FIG. 2 to FIG. 5, variations of the liquid hydrogen production system 1 are described. In these drawings, the same components as those described with reference to FIG. 1 are denoted by the same reference symbols as those illustrated in FIG. 1.

Figure 2:
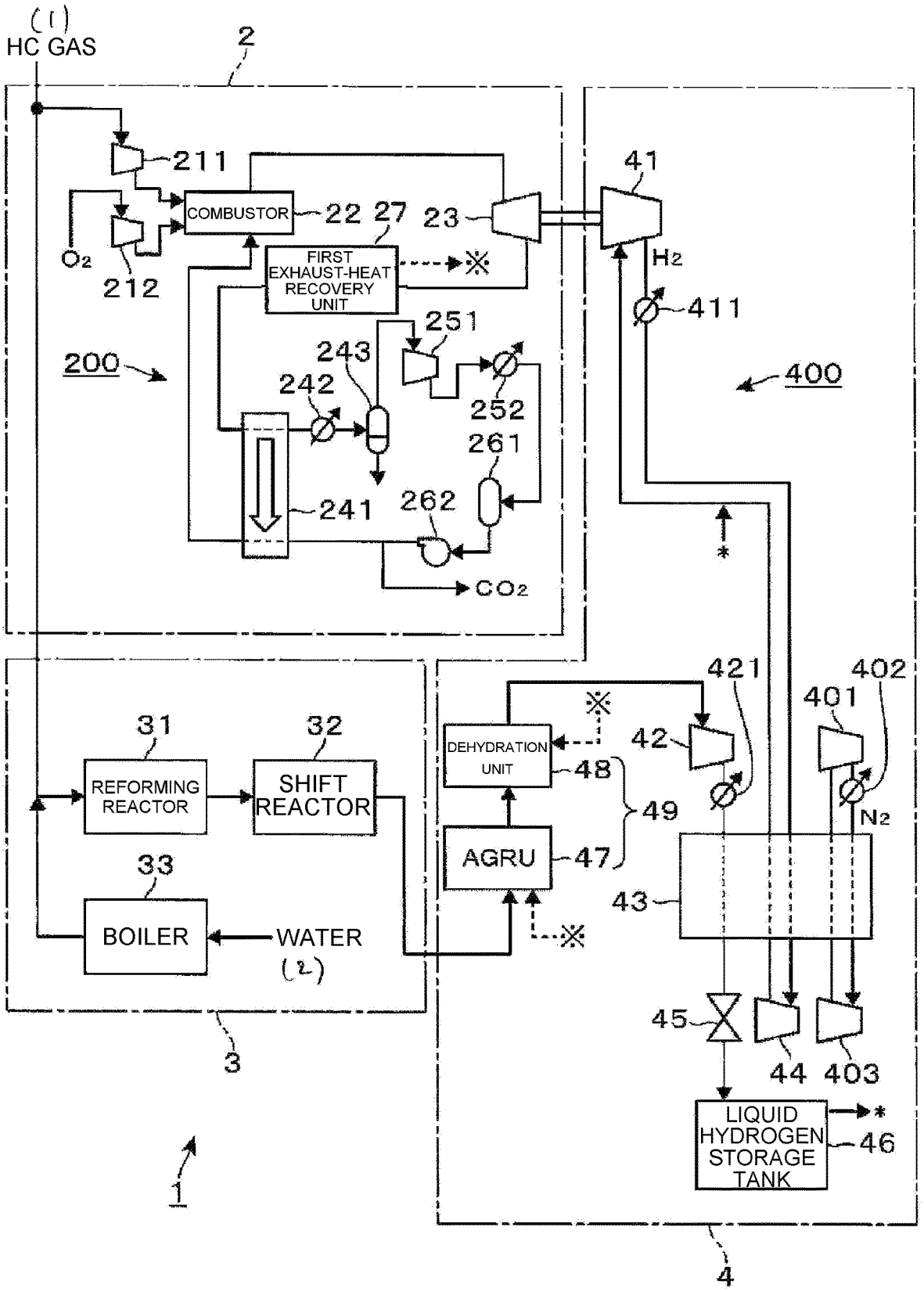
FIG. 2 is a configuration diagram for illustrating a liquid hydrogen production system including an exhaust-heat recovery unit that recovers exhaust heat of a turbine.

The SC-$CO_2$ cycle plant 2 may be configured so as to recover exhaust heat discharged from the turbine 23. For example, FIG. 2 shows an example in which an exhaust-heat recovery unit (first exhaust-heat recovery unit) 27 configured to recover exhaust heat of the turbine 23 is provided. The exhaust-heat recovery unit 27 is shown as being independent of the heat exchanger 241 in FIG. 2, but the heat exchanger 241 may also serve as the exhaust-heat recovery unit 27.

In the example illustrated in FIG. 2, heat recovered by the exhaust-heat recovery unit 27 is supplied to the dehydration unit 48 of the pretreatment unit 49 in the liquefaction plant 4. As described above, the dehydration unit 48 heats an adsorbent provided to the adsorption column during the regeneration process, to remove moisture from the adsorbent. The exhaust-heat recovery unit 27 heats gas supplied to the adsorption column (for example, synthesis gas in which moisture has been removed) as regeneration gas for the adsorbent.

With the above-mentioned configuration, emission of $CO_2$ can be reduced as compared to a case in which regeneration gas is heated by combustion of a fuel in a heating furnace.

Further, also in the AGRU 47 forming the pretreatment unit 49 together with the dehydration unit 48, heat recovered by the exhaust-heat recovery unit 27 can be used. For example, an absorption liquid in which acid gas has been removed by contact of synthesis gas with the absorption column is delivered to a regeneration column and then is heated by a reboiler, to emit acid gas and be regenerated. At that time, as a heat source of the reboiler, heat recovered by the exhaust-heat recovery unit 27 may be used.

With use of exhaust heat in the SC-$CO_2$ cycle plant 2 as described above, liquid hydrogen with less energy can be produced while reducing emission of $CO_2$ to the atmosphere.

Figure 3:
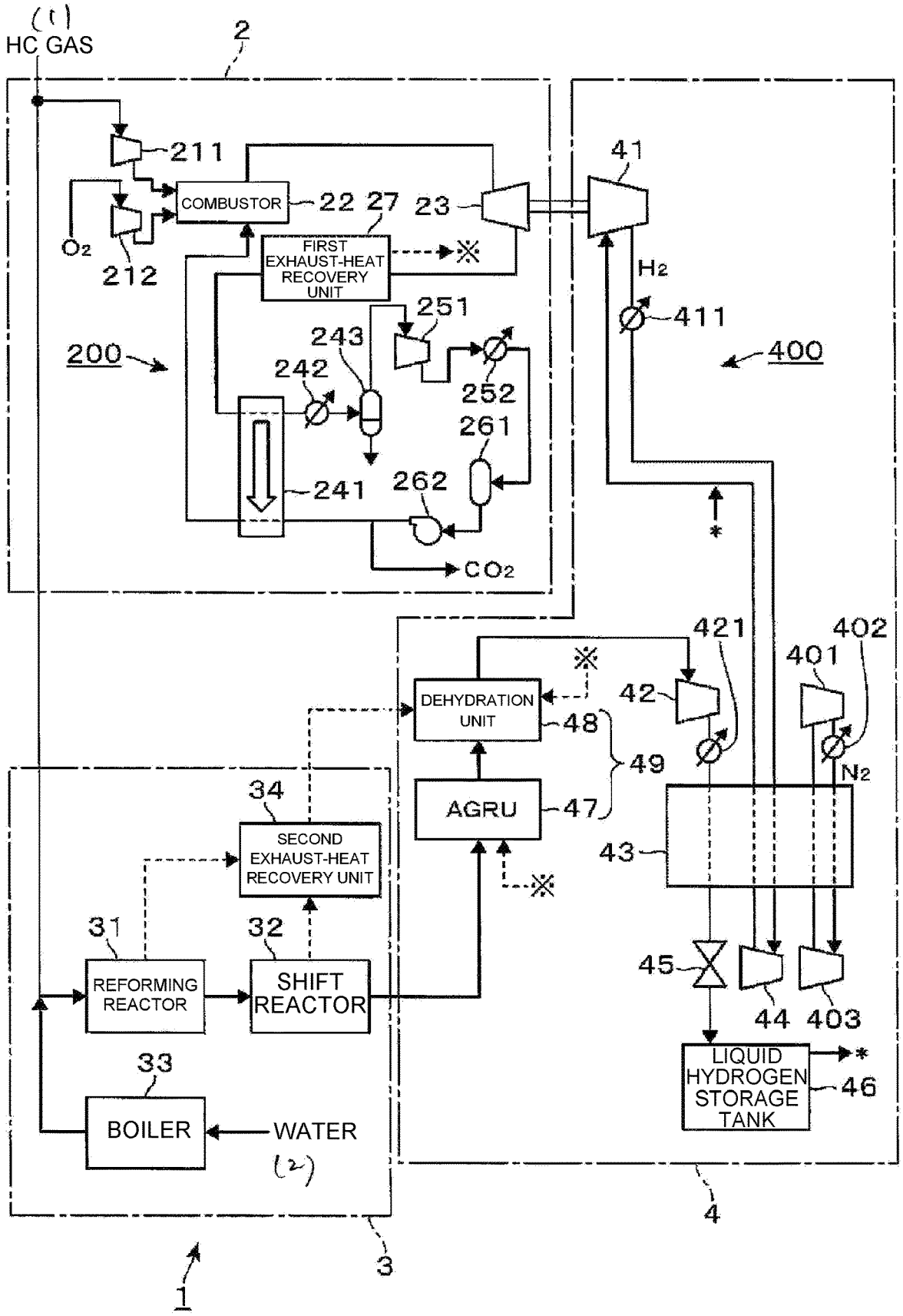
FIG. 3 is a configuration diagram for illustrating a liquid hydrogen production system including an exhaust-heat recovery unit that recovers heat generated in a hydrogen production plant.

Further, as illustrated in FIG. 3, in addition to the first exhaust-heat recovery unit 27 of the SC-$CO_2$ cycle plant 2, an exhaust-heat recovery unit (second exhaust-heat recovery unit) 34 may be provided also in the reforming reactor 31 of the hydrogen production plant 3. Moreover, as illustrated in FIG. 3, the second exhaust-heat recovery unit 34 may recover exhaust heat of the shift reactor 32 for an exothermic reaction. A configuration can be formed in which exhaust heat recovered by the second exhaust-heat recovery unit 34 is also used in the regeneration process of an adsorbent and an absorption liquid in the above-mentioned pretreatment unit 49.

In addition to the above-described examples, a boiler that uses, as a heat source thereof, exhaust heat of the turbine 23 that is recovered by the first exhaust-heat recovery unit 27, may be provided. Then, power generation may be performed by driving of a steam turbine with use of steam generated in the boiler. Further, exhaust heat recovered by the second exhaust-heat recovery unit 34 may also be used as a heat source for generating steam in the boiler.

Further, exhaust heat in combustion gas of the combustor 22 may be supplied to the boiler, to generate steam. Then, the steam turbine may be driven by the generated steam.

Further, $CO_2$ gas separated from the synthesis gas in the above-mentioned AGRU 47 may be recovered, to be supplied to, for example, the inlet side of the compressor 251 of the SC-$CO_2$ cycle plant 2.

Further, a second reforming reactor may be provided at a stage subsequent to the reforming reactor 31 in the hydrogen production plant 3. In the second reforming reactor, partial oxidation in which reformed gas generated in the reforming reactor 31 and $O_2$ gas are caused to react with each other takes place. With the second reforming reactor being provided, hydrocarbon left unreformed by the reforming reactor 31 can be reformed. Then, a part of $O_2$ gas produced in the ASU may be supplied to the second reforming reactor, in parallel with $O_2$ gas supplied to the combustor 22. Moreover, at that time, exhaust heat of the second reforming reactor may be recovered, to be used for a reforming reaction in the reforming reactor 31.

Further, exhaust heat of the shift reactor 32 may be recovered, to be used as a heat source for generating steam in the boiler 33.

Still further, exhaust heat recovered in the hydrogen production plant 3 may be used for heating $CO_2$ gas circulating through the $CO_2$ cycle 200. With this configuration, the temperature of $CO_2$ gas that is compressed by the compressor 251 and is returned back to the combustor 22 can be increased, and hence the thermal efficiency of the $CO_2$ cycle can be improved.

Figure 4:
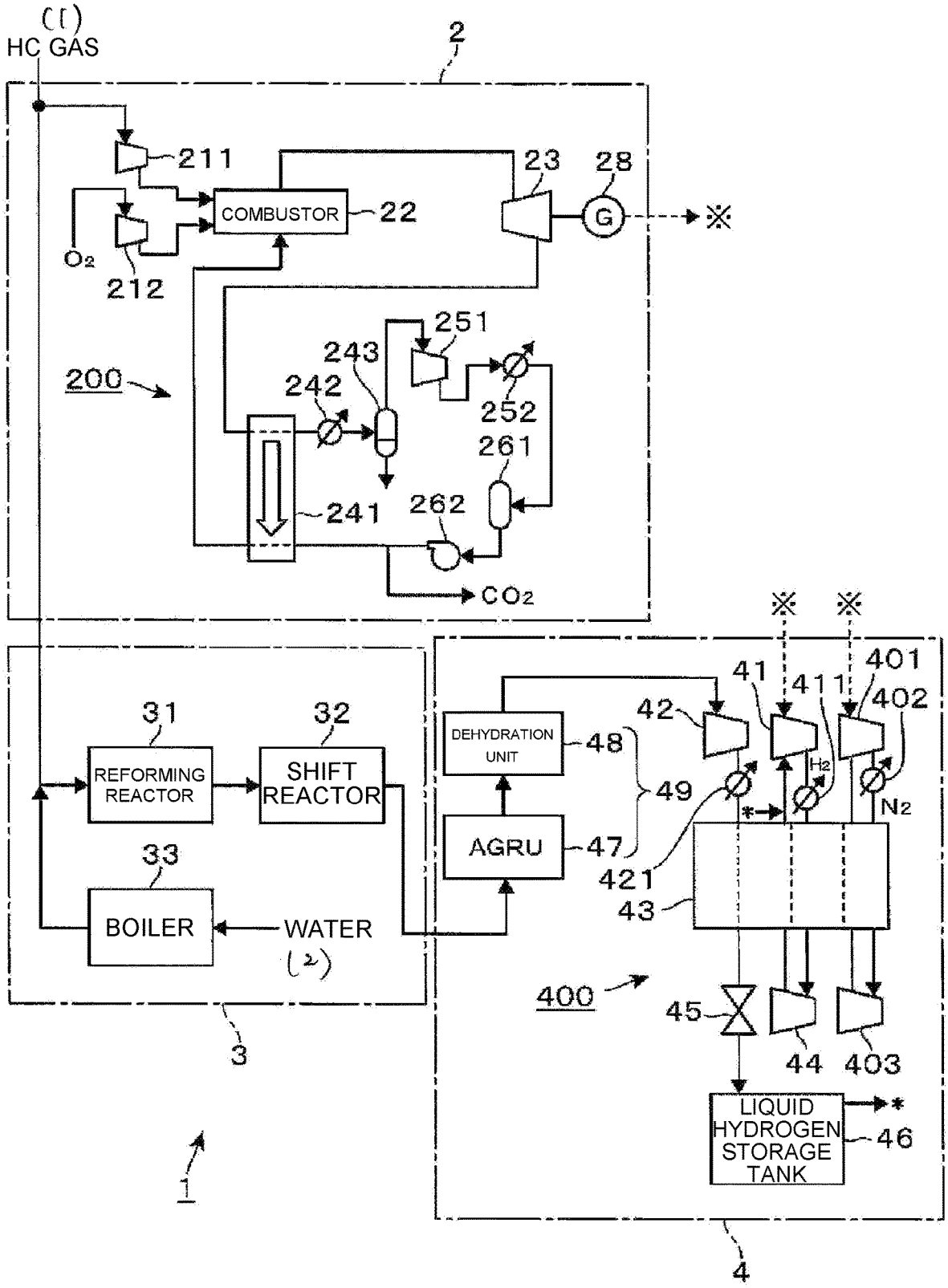
FIG. 4 is a configuration diagram for illustrating another example of the liquid hydrogen production system according to the embodiment.

Next, FIG. 4 shows an example in which power generation is performed in the SC-$CO_2$ cycle plant 2 and the generated power is supplied to the liquefaction plant 4 and consumed in the liquefaction plant 4. For example, as illustrated in FIG. 4, the turbine 23 drives a power generator 28, to generate power. Then, the power generated by the power generator 28 may be used for driving the refrigerant compressor 41 of the liquefaction plant 4.

Further, the power generated by the power generator 28 may be used for driving facilities placed in the liquefaction plant 4 and the hydrogen production plant 3, such as a heater and a blower. Moreover, in a case in which power generated in the SC-$CO_2$ cycle plant 2 is superfluous with respect to power consumption of respective power-consuming devices in the liquid hydrogen production system 1, the power may be supplied to areas and facilities outside of the liquid hydrogen production system 1.

Figure 5:
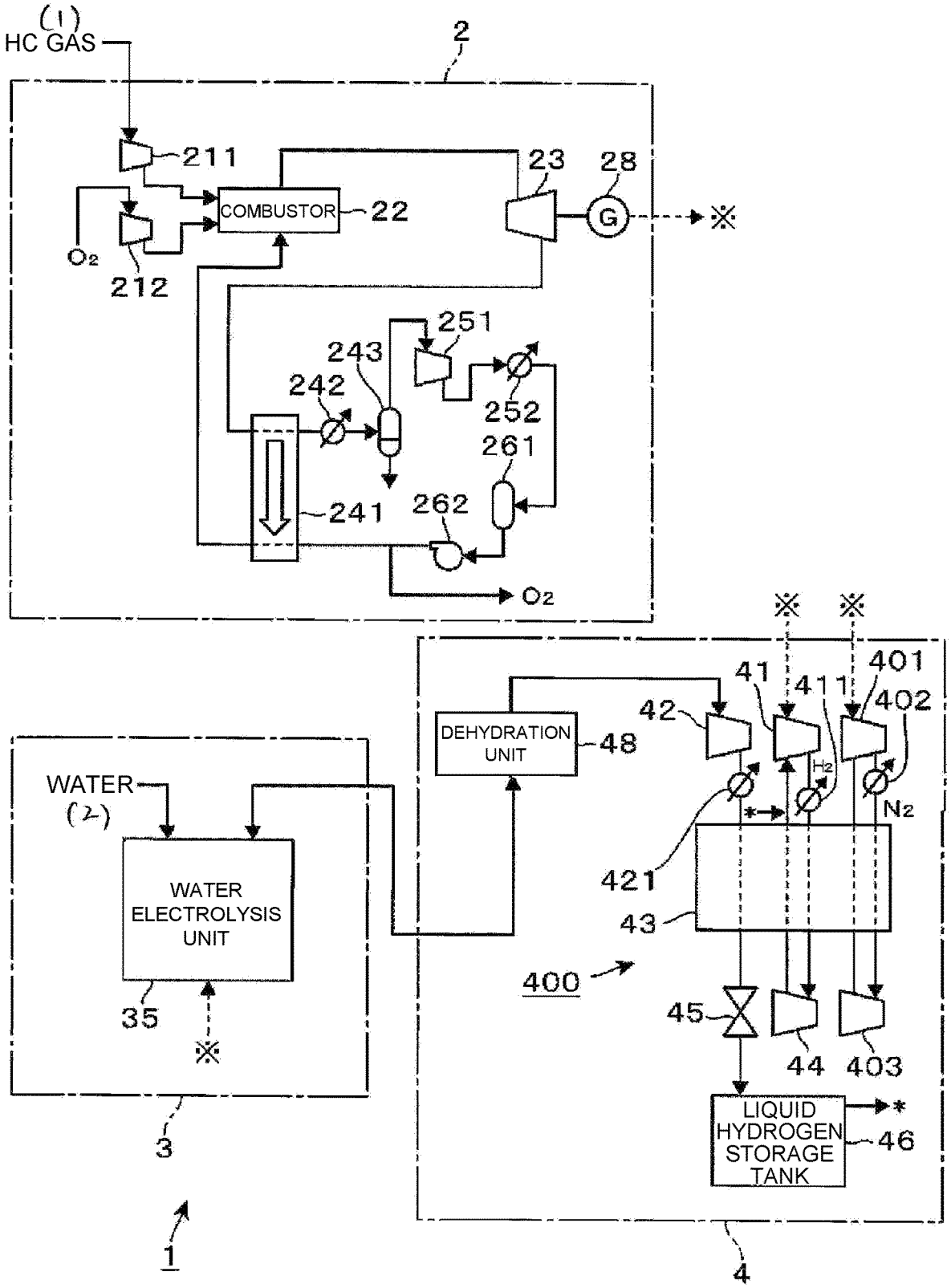
FIG. 5 is a configuration diagram for illustrating still another example of the liquid hydrogen production system according to the embodiment.

Still further, the hydrogen production plant 3 may be a plant that produces $H_2$ gas by, for example, water electrolysis. For example, as illustrated in FIG. 5, the hydrogen production plant 3 includes a water electrolysis unit 35 that electrolyzes water, and supplies $H_2$ gas produced in the water electrolysis unit 35 to the liquefaction plant 4. The water electrolysis unit 35 requires much power, and the power is generated by the power generator 28 in the SC-$CO_2$ cycle plant 2. This configuration can reduce emission of $CO_2$ during generation of power required for the water electrolysis unit 35.

Note that it is not essentially required that power generated by the power generator 28 be supplied to the water electrolysis unit 35. For example, regeneratable energy, power generated in another local power generation facility, or power purchased from outside may be supplied to the water electrolysis unit 35.

In this case, the motive power of the turbine 23 can be used for driving the compressor of the refrigerant compressor 41 in the same manner as in the example described with reference to FIG. 1. Various energy losses are caused in the course of power generation, and thus energy losses are reduced as compared to a case in which power is generated. Hence, from the viewpoint of efficient use of energy, the configuration in which the motive power of the turbine 23 is mechanically transmitted to drive the compressor of the refrigerant compressor 41 as illustrated in FIG. 1 may be employed.

Further, the SC-$CO_2$ cycle plant 2 is not limited to one having the configuration in which the turbine 23 is driven with use of SC-$CO_2$ to obtain motive power. For example, a case in which the SC-$CO_2$ cycle plant 2 configured so as to drive the turbine 23 with use of $CO_2$ gas to obtain motive power is employed is not excluded.

REFERENCE SIGNS LIST

1 liquid hydrogen production system
2 SC-$CO_2$ cycle plant
4 liquefaction plant
23 turbine

The invention claimed is:

1. A liquid hydrogen production device comprising:

a carbon dioxide cycle plant, which includes a turbine using a carbon dioxide fluid as a driving fluid, and is configured to drive the turbine to generate motive power with use of a carbon dioxide cycle in which the carbon dioxide fluid discharged from the turbine is increased in pressure and heated and is then re-supplied to the turbine; and a liquefaction plant configured to cool gaseous hydrogen by heat exchange with a refrigerant, to obtain liquid hydrogen, wherein the liquefaction plant comprises a refrigeration cycle including a refrigerant compressor configured to compress the refrigerant for cooling and liquefying the hydrogen, and the refrigerant compressor is connected to the turbine of the carbon dioxide cycle plant and is configured to be driven through mechanical transmission of the motive power generated in the turbine.

2. The liquid hydrogen production device according to claim 1, wherein the liquefaction plant further includes:

a hydrogen compressor configured to compress gaseous hydrogen;
and a heat exchanger configured to perform heat exchange between the compressed hydrogen and the refrigerant that is adiabatically expanded to have a reduced temperature, to cool the compressed hydrogen and obtain the liquid hydrogen, and the refrigeration cycle further includes an expansion turbine or a pressure reducing value configured to cool the refrigerant compressed by the refrigerant compressor and adiabatically expand the refrigerant, to reduce a temperature of the refrigerant.

3. The liquid hydrogen production device according to claim 1, further comprising a hydrogen production plant configured to produce the gaseous hydrogen.

4. The liquid hydrogen production device according to claim 3, wherein the hydrogen production plant is configured to produce gaseous hydrogen by reforming hydrocarbon with steam.

5. The liquid hydrogen production device according to claim 1, further comprising a pretreatment unit configured to perform at least one of dehydration of gaseous hydrogen before liquefaction in the liquefaction plant, or removal of carbon dioxide mixed into gaseous hydrogen.

6. The liquid hydrogen production device according to claim 5, wherein, in a case in which the pretreatment unit performs at least one of dehydration with use of an adsorbent or removal of the carbon dioxide with use of an absorption liquid, the liquid hydrogen production device further comprises a first exhaust-heat recovery unit configured to recover heat from the carbon dioxide fluid provided after the turbine of the carbon dioxide cycle plant is driven, and wherein the heat recovered by the first exhaust-heat recovery unit is used for a regeneration process performed by heating the adsorbent or the absorption liquid.

7. The liquid hydrogen production device according to claim 5, wherein, in a case in which the pretreatment unit performs at least one of dehydration with use of an adsorbent or removal of the carbon dioxide with use of an absorption liquid, the liquid hydrogen production device further comprises a hydrogen production plant that is configured to produce the gaseous hydrogen, and includes:

a reforming unit configured to reform hydrocarbon by causing a reaction with steam to produce gaseous hydrogen; and a second exhaust-heat recovery unit configured to recover heat generated by the reaction between steam and hydrocarbon in the reforming unit, and wherein the heat recovered by the second exhaust-heat recovery unit is used for a regeneration process performed by heating the adsorbent or the absorption liquid.

* * * * *